United States Patent [19]

Martin

[11] 4,153,218

[45] May 8, 1979

[54] DANCER ASSEMBLY

[76] Inventor: John R. Martin, Martin Automatic, Inc, 1661 Northrock Ct., Rockford, Ill. 61103

[21] Appl. No.: 900,971

[22] Filed: Apr. 27, 1978

[51] Int. Cl.[2] ..... B65H 23/16

[52] U.S. Cl. ..... 242/75.3

[58] Field of Search ..... 242/75.3, 75, 75.5, 242/75.52, 75.53; 226/195

[56] References Cited

U.S. PATENT DOCUMENTS

| | | | |
|---|---|---|---|
| 3,249,315 | 5/1966 | Peltier | 242/75.3 |
| 3,365,143 | 1/1968 | Espel | 242/75.51 |
| 3,650,490 | 3/1972 | Saunders | 242/75.3 |

*Primary Examiner*—Edward J. McCarthy

*Attorney, Agent, or Firm*—Allegretti, Newitt, Witcoff & McAndrews

[57] ABSTRACT

A dancer assembly for establishing a plurality of preselected operating tensions in a moving web includes a pivotable first support member, on which a second support member is cantilevered. A dancer roller is rotatably mounted on bearings at the outboard end of the second support member. The parallelism of the dancer roller with respect to its idler rollers is maintained over the range, by matching the support members so that the torsional deflection of the first support member is cancelled by the transverse deflection of the second support member.

5 Claims, 6 Drawing Figures

DANCER ASSEMBLY

BACKGROUND OF THE INVENTION

This invention relates to an apparatus or dancer for establishing a plurality of operating tensions in a moving web, and more particularly, to a dancer assembly in which the dancer roller support structure is mounted in a cantilevered fashion.

Generally, dancers are well-known to the art of controlling a moving, high-speed web such as paper. In a typical installation, a dancer is used in association with two idler rollers which are mounted for rotation about parallel axes. The dancer includes a dancer roller mounted on a support structure for rotation about an axis parallel to the rotational axes of the idler rollers. The support structure is mounted for pivoting about another axis parallel to the axes of the idler rollers. The web is passed across one idler roller, around the dancer roller, across the other idler roller and into web consuming or processing equipment. As the surface velocity of the unwinding roll increases and decreases relative to the velocity of the web processing equipment, the support structure pivots the dancer roller toward and away from the idler rollers, and the rotational velocity of the dancer roller increases and decreases. As a result, a constant operating tension, pre-selected for the type of web material and the type of web processing equipment, is established.

A problem inherent in dancer assemblies as described is wrinkling of the web. That is, the rotational axis of the dancer roller must be kept substantially parallel to the axes of the idler rollers, or the web material will develop axial stresses, causing the web to fail in the lateral, or cross-web, direction, and overlap itself. To avoid this problem, in the past, dancer assemblies have been disclosed in which the dancer roller, as well as the support structure and the idler rollers, are mounted on laterally spaced bearings. Fixed axes for rotation are thus established, and precise positioning of the bearings results, ideally, in parallel axes for all the equipment.

SUMMARY OF THE INVENTION

In contrast with prior art devices, it is a principal object of the present invention to provide a dancer assembly in which the dancer roller support structure is mounted in a cantilevered fashion.

Another principal object of the present invention is to provide a dancer assembly in which the dancer roller support structure is cantilevered and a substantially parallel relationship is maintained between the dancer roller and the idler rollers over a range of pre-selected operating tensions.

Another object of the present invention is to provide a dancer assembly in which the dancer roller support structure is cantilevered and which overcomes torsional deflection of the support structure that causes nonparallelism of the dancer roller.

A further object of the present invention is to provide a dancer assembly in which the dancer roller support structure is cantilevered, which is conservative of materials.

These and other objects and advantages are satisfied by the present invention, which, in a principal aspect, is a dancer assembly for establishing a range of preselected operating tensions in a moving web which comprises: a first support member pivotable about an axis that is parallel to the planes defined by the web; a second support member fixedly cantilevered on the first support member and having an outboard end; a dancer roller; and means for rotatably mounting the dancer roller on the outboard end only of the second support member, the dancer assembly including no other means for mounting the dancer roller than the bearing means; the first support member and the second support member being matched so that over the range the rotational axis of the dancer roller is maintained in substantially parallel positions.

As thus described, the present invention satisfies the stated objects by including a dancer roller which is mounted on only the outboard end of a cantilevered second support member. This mounting of the dancer roller permits the second support member to bend as a loaded cantilever beam bends, resulting in transverse deflection of the second support member at the outboard end. This beam deflection counteracts the nonparallelism caused by the shaftlike , torsional deflection of the first support member. Because the support members are matched, these two deflections, namely the beam deflection and the torsional deflection, substantially cancel, whereby the dancer roller remains substantially parallel to the idler rollers, regardless of the specific operating tension.

A more complete description of the manner in which the present invention satisfies the stated object and provides other important advantages will be set forth in the detailed description of the preferred embodiment, which follows.

BRIEF DESCRIPTION OF THE DRAWING

The preferred embodiment of the present invention will be described in relation to the drawing, wherein.

DETAILED DESCRIPTION OF THE PREFERRED EMBODIMENT

Figure 1:
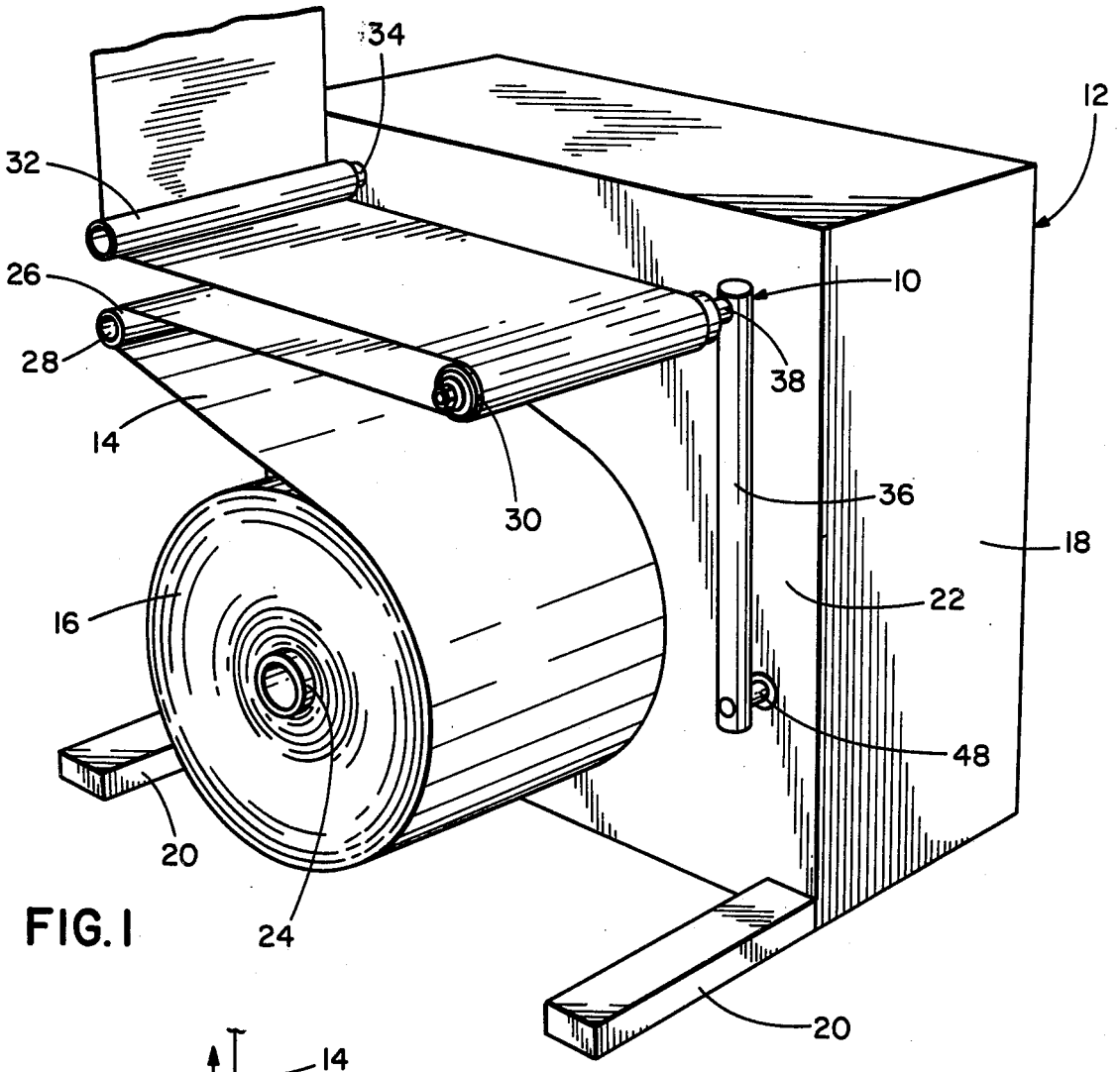
FIG. 1 is a perspective view of an unwind stand for unwinding a roll of web material, which incorporates the preferred embodiment of the present invention.

Referring to FIG. 1, the preferred embodiment of the present invention is shown and generally designated as a dancer assembly 10 incorporated into an unwind stand 12 for unwinding a web material 14 from a roll 16.

As shown, the unwind stand 12 includes an upright base or housing 18 having two horizontally spaced and elongated feet 20 extending from a vertical, planar side 22 thereof. The feet 20 aid in counteracting the instability caused by the cantilevered mounting of the roll 16, which is mounted or chucked on a cylindrical shaft or spindle 24. The spindle 24 is cantilevered on the base 18 for rotation about a first axis, which extends substantially horizontally outward from the central portion of the side 22.

The web 14 unwinds counterclockwise from the top of the roll 16 to a first idler roller 26. An elongated , cylindrical first idler shaft 28 supports the first idler roller 26. The first idler shaft 28 is cantilevered on the base 18, and the first idler roller 26 is mounted on roller bearings (not shown) spaced along the first idler shaft 28. The first idler roller 26 is thus mounted for rotation about the longitudinal axis of the first idler shaft 28, which axis is normally substantially parallel to the axis of the spindle 24 and spaced above and horizontally offset therefrom.

After traveling approximately 135° around the first idler roller 26, the web 14 moves horizontally off the first idler roller 26 to a dancer roller 30, 135° around the dancer roller 30 and horizontally back to a second idler roller 32. From there, the web 14 travels 90° around the second idler roller 32 and vertically upward into web processing equipment (not shown) such as a printing press.

Like the first idler roller 26, the second idler roller 32 is mounted on bearings (not shown), spaced longitudinally along a second idler shaft 34. The second idler shaft 34 is cantilevered on the base 18, and its longitudinal axis defines an axis for rotation of the second idler roller 32. Spaced directly above the first idler roller 26 at a distance substantially equal to the diameter of the dancer roller 30, the second idler roller 32 is also normally substantially parallel to the first idler roller 26.

Figure 3:
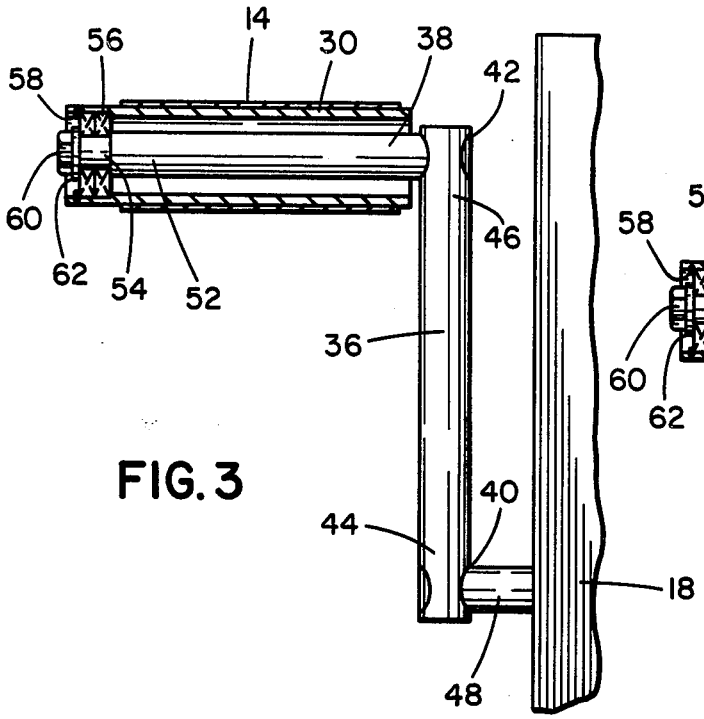
FIG. 3, is a cross-sectional view taken along line 3—3 of FIG. 2.

Turning now to the dancer assembly 10, as detailed in FIGS. 1 and 3, a first support member such as the first shaft 36 is pivotally mounted on the base 18 and a second support member such as the second shaft 38 is cantilevered from the first shaft 36. More specifically, the first shaft 36, which is elongated and substantially cylindrical , has two substantially parallel openings 40, 42 drilled transversely through the ends 44, 46 thereof. Fitted through the opening 40 in the lower end 44 and welded thereto is a short, substantially cylindrical stub shaft 48, which is pivotally mounted on the base 18. Fitted through the opening 42 in the upper end 46 and welded thereto is the inner end 50 of the elongated, substantially cylindrical second shaft 38.

The pivotal axis of the stub shaft 48 is normally substantially parallel to the axis of the spindle 24, and thus the first shaft 36 is mounted for pivoting in a plane substantially perpendicular to the axes of the spindle 24 and the idler rollers 26, 32. The second shaft 38 pivots with the first shaft 36 and normally extends outward therefrom substantially parallel to said axes.

At the outer or outboard end 52 of the second shaft 38, a co-axial shaft extension 54 of reduced outer diameter forms a cylindrical seat for bearings 56. An annular bearing retainer 58 mounted along the inside of the dancer roller 30 holds the bearings 56 on a radially enlarged cylindrical recess inside the dancer roller 30, and a fastener such as bolt 60 secures an annular retaining member or washer 62 to the extension 54 to hold the bearings 56 thereon. The dancer roller 30 is thus mounted on the second shaft 38 at its outboard end only.

The first shaft 36 and the second shaft 38 are matched. That is, the dimensions of the two shafts 36, 38 are chosen so that over a range of pre-selected operating tensions, the torsional deflection of the first shaft 36 about its longitudinal axis is substantially cancelled by the transverse deflection or bending of the second shaft 38. As preferred, the shafts 36, 38 are elongated and cylindrical. Thus, it is believed that the classic equations for torsion in a cylindrical shaft and for bending in a cantilevered beam can be utilized to model the assembly 10, and balance the shafts 36, 38.

Figure 2:
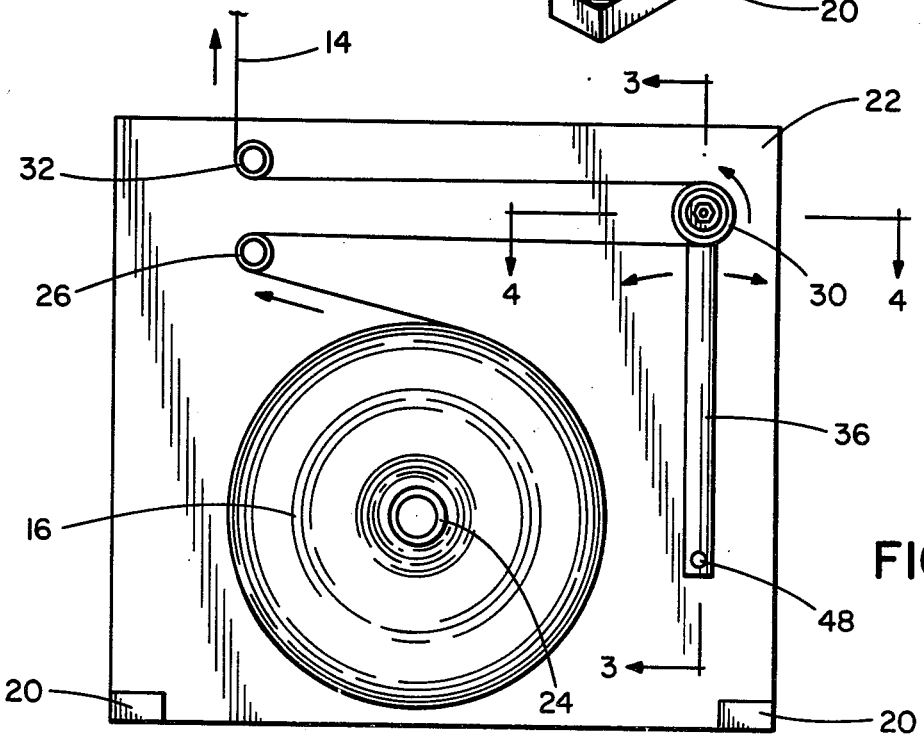
FIG. 2 is a side view of the unwind stand of FIG. 1.
Figure 4:
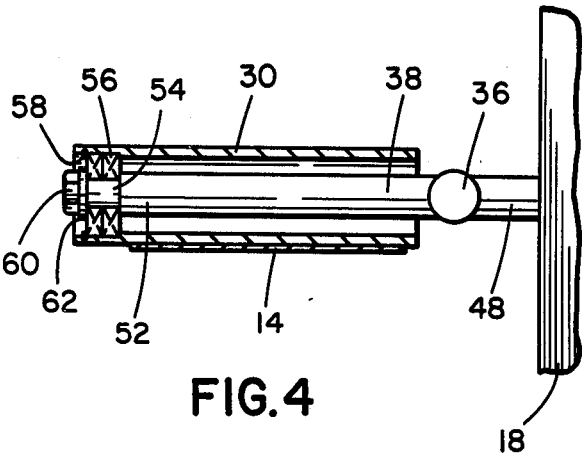
FIG. 4 is a cross-sectional view taken along line 4—4 of FIG. 2.
Figure 6:
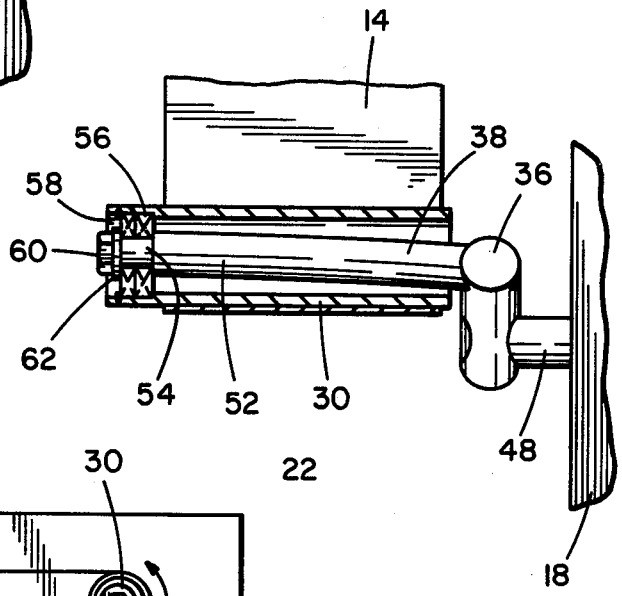
FIG. 6 is a cross-sectional view similar to FIG. 4 taken along line 6—6 of FIG. 5.
Figure 5:
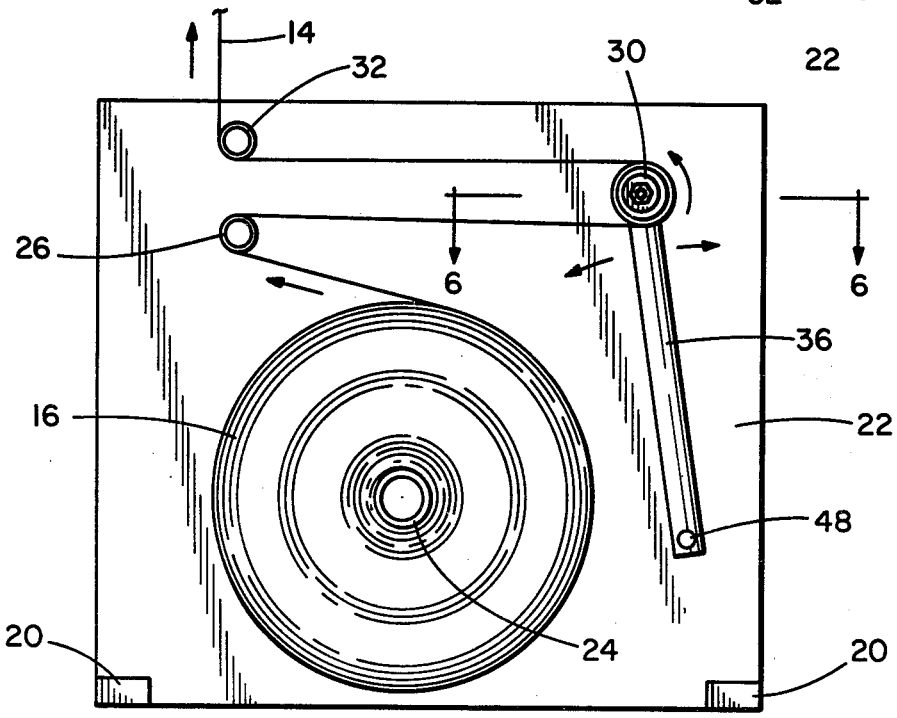
FIG. 5 is a side view similar to FIG. 2.

A principal advantage of the dancer assembly 10 as thus described can be seen by comparing FIGS. 2 and 4 with FIGS. 5 and 6. As shown in FIGS. 2 and 4, the dancer assembly 10 is operating at a low operating tension. In this state, the shafts 36, 38 are substantially undeflected and the dancer roller 30 is substantially parallel to the idler rollers 26, 32.

In contrast with FIGS. 2 and 4, in FIGS. 5 and 6, the dancer assembly 10 is operating at a relatively high tension selected to suit the particular web processing equipment being utilized. As a result of the relatively high operating tension, the first shaft 36 has become twisted about its longitudinal axis and the second shaft 38 has become transversely deflected or bent. However, because the shafts 36, 38 have been balanced or matched, the torsional deflection of the first shaft 36 substantially cancels the transverse deflection of the second shaft 38. The outer end of the second shaft 38 and the dancer roller 30 thus remain substantially parallel to the idler rollers 26, 32, and the web 14 remains in its pre-selected lateral position, substantially free of axial stress.

From the foregoing, it should be apparent to those having skill in the art that modifications could be made in the dancer assembly described. For example, the horizontal orientation of the spindle 24, the idler rollers 26, 32 and the dancer assembly 10 could be varied to match that of other web processing equipment. Further, the shafts 36, 38 could be non-cylindrical. Thus, the preferred embodiment 10 should be considered to be illustrative and not restrictive. All equivalents which come within the range of the claims are intended to be embraced therein.

What is claimed is:

1. A dancer assembly for establishing a plurality of pre-selected operating tensions in a moving web comprising, in combination:

a first support member pivotable about an axis that is parallel to the planes defined by said web;

a second support member cantilevered on said first support member and having an outboard end;

a dancer roller; and bearing means for rotatably mounting said dancer roller on said outboard end only of said second support member, said dancer assembly including no other means for mounting the dancer roller than said bearing means;

said first support member and said second support member matched so that over a range of pre-selected operating tensions, the deflections of said support members substantially cancel and said dancer roller is maintained in substantially parallel positions.

2. A dancer assembly as claimed in claim 1 wherein said first support member is elongated in a direction perpendicular to the planes defined by said web, and said second support member is elongated in a direction perpendicular to the elongation of said first support member.

3. A dancer assembly as claimed in claim 2 wherein said first support member is substantially cylindrical and said second support member is substantially cylindrical.

4. A dancer assembly as claimed in claim 1 wherein said mounting means includes bearing means.

5. Improved apparatus for unwinding web material from a roll comprising:

a stand;

a spindle for mounting of said roll rotatably mounted on said stand for rotation about a first axis;

a dancer assembly including a dancer roller over which said web material passes after being unwound from said roll;

an idler roller over which said web material passes from said dancer roller, said idler roller rotatably mounted on said stand for rotation about a second axis substantially parallel to said first axis;

said dancer assembly further including a first shaft pivotable about a third axis that is substantially parallel to said axes and having a free end that extends in a direction perpendicular to said axes, a second shaft cantilevered on said free end having an outboard end extending in a direction parallel to said axes, and bearing means for rotatably mounting said dancer roller on said outboard end, said first shaft and said second shaft matched so that over a range of pre-selected operating tensions, the torsional deflection of said free end is substantially cancelled by the transverse deflection of said outboard end and said dancer roller is maintained in substantially parallel positions.

* * * * *